US010138808B2

(12) United States Patent
Gonzalez

(10) Patent No.: US 10,138,808 B2
(45) Date of Patent: Nov. 27, 2018

(54) DUAL PISTON ENGINE COMPRESSION DEVICE

(71) Applicant: Juan P. Gonzalez, Everett, WA (US)

(72) Inventor: Juan P. Gonzalez, Everett, WA (US)

( * ) Notice: Subject to any disclaimer, the term of this patent is extended or adjusted under 35 U.S.C. 154(b) by 0 days.

(21) Appl. No.: 14/669,210

(22) Filed: Mar. 26, 2015

(65) Prior Publication Data

US 2016/0281599 A1 Sep. 29, 2016

(51) Int. Cl.
*F02B 75/28* (2006.01)
*F01B 7/14* (2006.01)

(52) U.S. Cl.
CPC ..... *F02B 75/282* (2013.01); *F01B 7/14* (2013.01)

(58) Field of Classification Search
CPC ..... F02B 75/26; F02B 75/28
USPC ..... 123/51 R
See application file for complete search history.

(56) References Cited

U.S. PATENT DOCUMENTS 2,070,769 A 2/1937 Wurtele
2,462,092 A 2/1949 Gehrandt
2,494,890 A * 1/1950 Mallory ..... F01B 7/14 119/900
4,363,295 A * 12/1982 Brandly ..... F02B 41/02 123/197.2
4,554,894 A 11/1985 Johnson
5,133,306 A 7/1992 Honkanen
6,039,011 A 3/2000 Agalarov et al.
6,532,916 B2 3/2003 Kerrebrock
D494,191 S 8/2004 Aketa et al.
7,004,120 B2 2/2006 Warren

FOREIGN PATENT DOCUMENTS

JP 06200783 A * 7/1994

* cited by examiner

*Primary Examiner* — Kevin A Lathers

(57) ABSTRACT

A dual piston engine compression device provides opposed pistons in linear alignment for compressing explosive gases within an engine block cylinder. The device includes an engine block having a plurality of cylinders having linearly aligned open ends. Each of a pair of piston crankshafts is positioned on a respective side of the engine block in alignment with the cylinders. Pistons are positioned in pairs within each cylinder and coupled to an associated one of the piston crankshafts such that rotation of the piston crankshafts moves the pistons within the associated cylinder. Each piston crankshaft is rotated by an associated gear. The gears are geared together coordinating the piston crankshafts to alternately urge oppositely positioned pistons together and apart within the associated cylinders as the piston crankshafts rotate.

7 Claims, 3 Drawing Sheets

DUAL PISTON ENGINE COMPRESSION DEVICE

BACKGROUND OF THE DISCLOSURE

Field of the Disclosure

The disclosure relates to engine devices and more particularly pertains to a new engine device for providing opposed pistons in linear alignment for compressing explosive gases within an engine block cylinder.

SUMMARY OF THE DISCLOSURE

An embodiment of the disclosure meets the needs presented above by generally comprising an engine block having a plurality of cylinders having linearly aligned open ends. Each of a pair of piston crankshafts is positioned on a respective side of the engine block in alignment with the cylinders. Pistons are positioned in pairs within each cylinder and coupled to an associated one of the piston crankshafts such that rotation of the piston crankshafts moves the pistons within the associated cylinder. Each piston crankshaft is rotated by an associated gear. The gears are geared together coordinating the piston crankshafts to alternately urge oppositely positioned pistons together and apart within the associated cylinders as the piston crankshafts rotate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
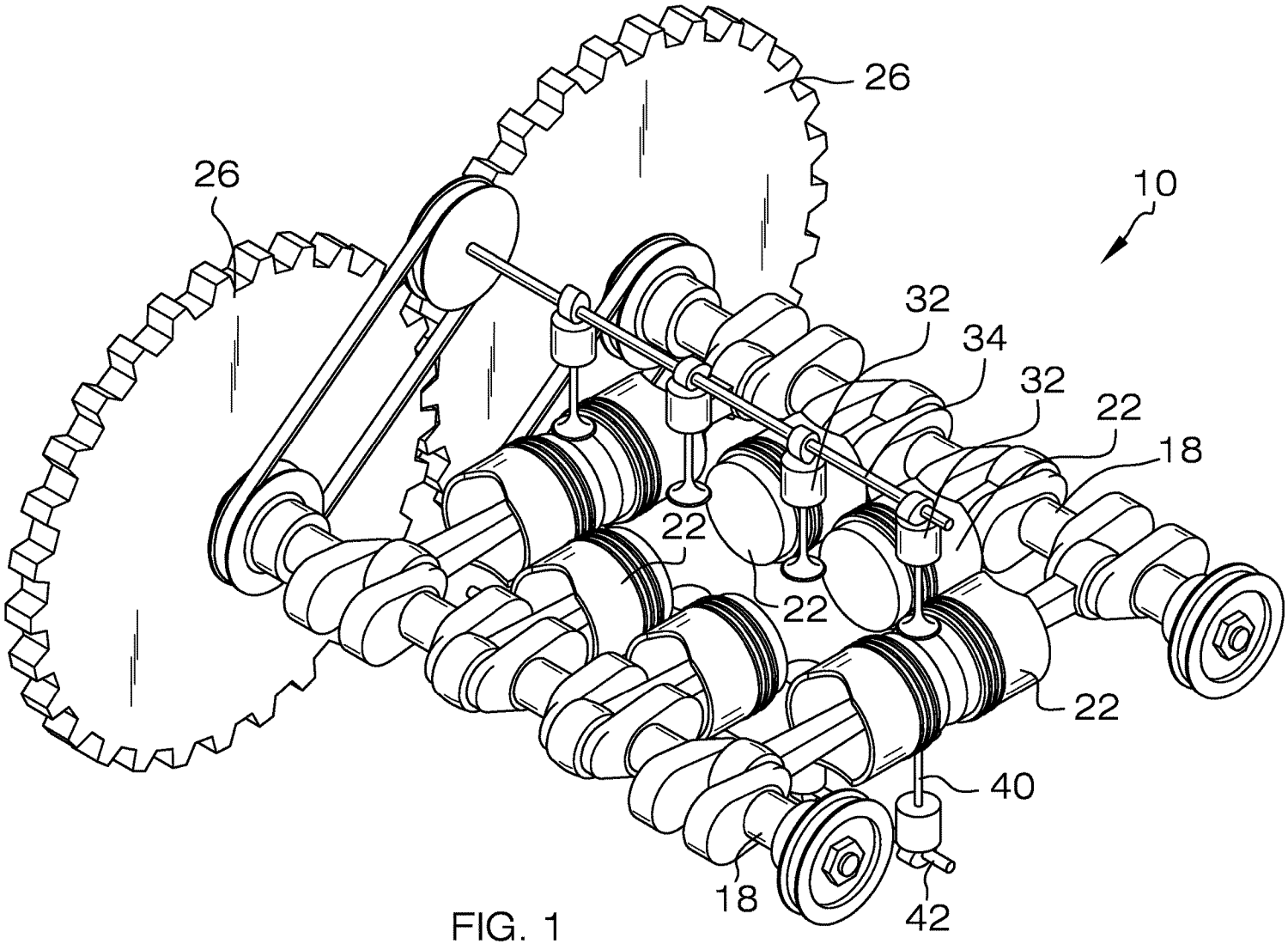
FIG. 1 is a top front side view of a dual piston engine compression device according to an embodiment of the disclosure.
Figure 2:
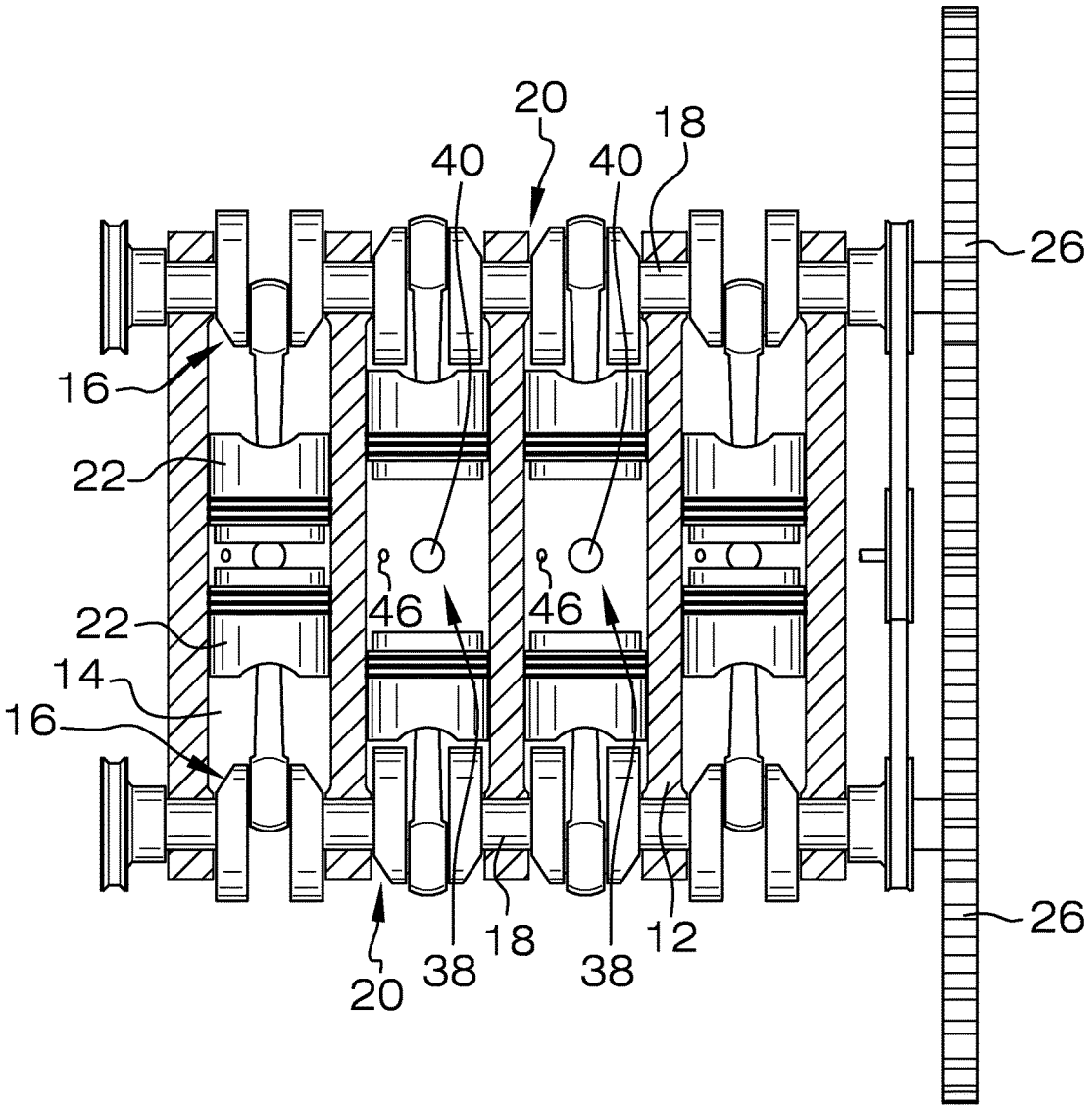
FIG. 2 is a top view of an embodiment of the disclosure.
Figure 3:
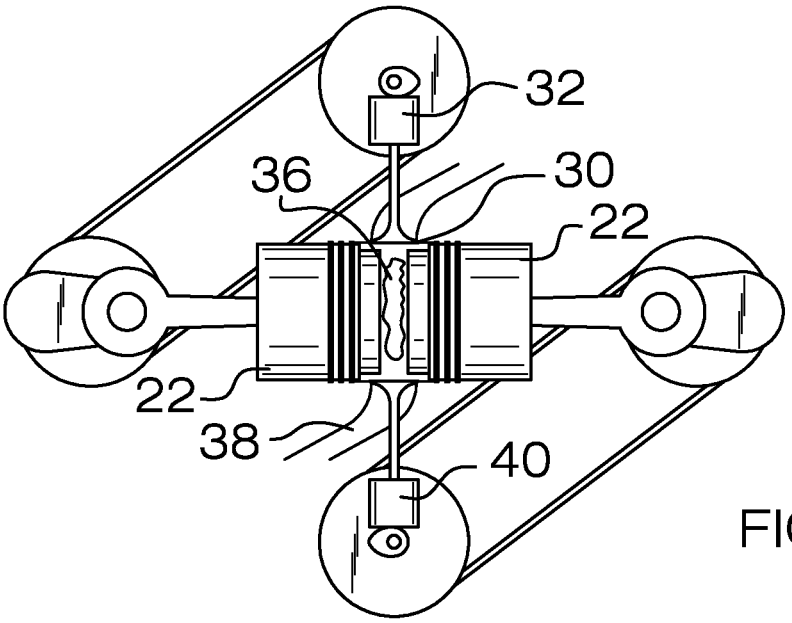
FIG. 3 is a front view of an embodiment of the disclosure.
Figure 4:
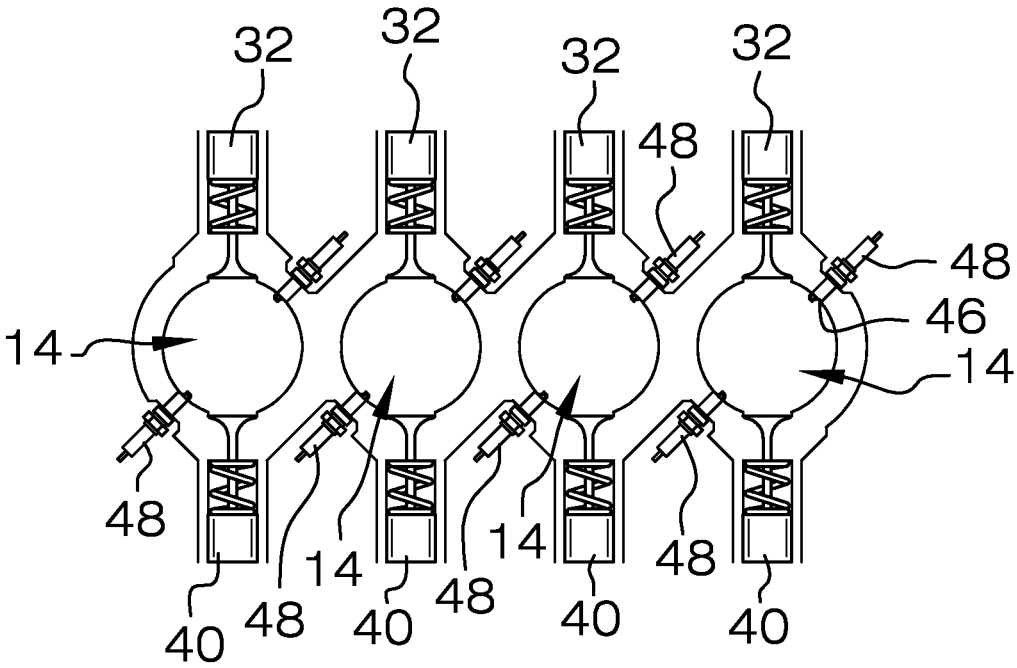
FIG. 4 is a partial side view of an embodiment of the disclosure.

With reference now to the drawings, and in particular to FIGS. 1 through 4 thereof, a new engine device embodying the principles and concepts of an embodiment of the disclosure and generally designated by the reference numeral 10 will be described.

As best illustrated in FIGS. 1 through 4, the dual piston engine compression device 10 generally comprises an engine block 12 having a plurality of cylinders 14. Each cylinder 14 has a pair of linearly aligned open ends 16 such that each cylinder extends across the engine block 12. The engine block 12 is constructed of a conventional material and is partially shown throughout the drawing figures for clarity of revealing the underlying structure. Each of a pair of piston crankshafts 18 is positioned on a respective side 20 of the engine block 12. Each piston crankshaft 18 is positioned in alignment with the cylinders 14 such that each piston crankshaft 18 extends across the open ends 16 to a respective side of the engine block 12. Each of a plurality of pistons 22 is positioned in an associated one of the cylinders 14 to form aligned piston pairs 24 within each cylinder 14. Each piston 22 is operationally coupled to an associated one of the piston crankshafts 18 such that rotation of the piston crankshaft 18 moves the piston 22 within the associated cylinder 14. Each piston crankshaft 18 is coupled to and rotated by an associated one of a pair of gears 26. The gears 26 are geared together such that rotation of the piston crankshafts 18 is coordinated. Thus, the piston crankshafts 18 alternately urge oppositely positioned pistons 22 in each piston pair 24 together and apart within the associated cylinders 14 as the piston crankshafts 18 rotate.

Each of a plurality of intake conduits 30 extends through the engine block 12 and is in environmental communication with an associated one of the cylinders 14 in a conventional manner. Each of a plurality of intake valves 32 is positioned in an associated one of the intake conduits 30 in a conventional manner. Each intake valve 32 is transversely oriented relative to the associated cylinder 14. Each of the intake valves 32 is coupled to an intake camshaft 34. The intake camshaft 34 is rotated by rotation of the gears 26 wherein each intake valve 32 moves within the associated intake conduit 30 for allowing or urging a fuel 36 into the associated cylinder 14 in a conventional manner when the fuel 36 after the fuel 36 is introduced into the associated intake conduit 30.

Each of a plurality of exhaust conduits 38 extends through the engine block 12 and is in environmental communication with an associated one of the cylinders 14. Each of a plurality of exhaust valves 40 is positioned in an associated one of the exhaust conduits 38. Each intake valve 32 is linearly aligned with an associated one of the exhaust valves 40. Each of the exhaust valves 40 is coupled to an exhaust camshaft 42. The exhaust camshaft 42 is rotated by rotation of the gears 26 similarly to the rotation of the intake camshaft 34. Each exhaust valve 40 moves within the associated exhaust conduit 38 such that each exhaust valve 40 is configured for removal of combusted fuel out of the associated cylinder 14 in a conventional manner after the fuel 36 is ignited within the associated cylinder 14. Each cylinder 14 is structured to include a spark plug aperture 46 wherein each cylinder 14 is configured for ignition of the fuel 36 within each cylinder 14 by a respective spark plug 48 coupled to the engine block 12 adjacent to the spark plug aperture 46 in each cylinder 14. Each spark plug aperture 46 is positioned proximate the exhaust conduit 38 in the associated cylinder 14. The movement of the pistons 22, compression of the fuel 36, intake of the fuel 36 and exhaust of the combusted fuel is generally conventional in function. Thus, one skilled in the art would be able to structure the engine block 12 to provide the above described positional relationships and functions.

In use, each cylinder 14 provides for alternating separation and moving together of the piston pairs 24. The fuel 36 is introduced into each cylinder 14 by movement of the piston pairs 24 in a separating motion while the associated intake valve 32 is open. The piston pair 24 compresses and the spark plug 48 is fired to combust the fuel 36 driving for separation of the piston pair 24. Compression by the piston pair 24 immediately after combustion is coordinated with opening of the exhaust valve 40 prior to opening of the intake valve 32 and introduction of new fuel into the cylinder 14. The device 10 may be used to rotate a driveshaft in conventional fashion to produce work.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dual piston engine compression device comprising:

an engine block having a plurality of cylinders, each cylinder having a pair of linearly aligned open ends;

a pair of piston crankshafts, each said piston crankshaft being positioned on a respective side of said engine block, each said piston crankshaft being positioned in alignment with said cylinders;

a plurality of pistons, each of said pistons being positioned in an associated one of said cylinders to provide an opposed pair of said pistons within each said cylinder, each of said pistons being operationally coupled to an associated one of said piston crankshafts such that rotation of said piston crankshaft moves said piston within said associated cylinder, each said piston having an end protrusion, said end protrusion being disc-shaped and having a diameter less than a diameter of a main section of said piston, said end protrusion being concentric with said main section of said piston such that said piston has a uniform lip extending around a distal end of said piston;

a pair of gears, each said piston crankshaft being coupled to and rotated by an associated one of said gears, said gears being geared together wherein rotation of said piston crankshafts is coordinated such that said piston crankshafts alternately urge oppositely positioned said pistons together and apart within said associated cylinders as said piston crankshafts rotate;

a plurality of intake conduits, each intake conduit extending through said engine block and being in environmental communication with an associated one of said cylinders, each said intake conduit being positioned between said opposed pair of said pistons such that said distal ends of each of said opposed pair of pistons remains spaced offset from crossing a central longitudinal axis of said intake conduit and only said end protrusion extends over said intake conduit when said opposed pair of said pistons are each fully extended into said associated one of said cylinders;

a plurality of intake valves, each said intake valve being positioned in an associated one of said intake conduits; and an intake camshaft, each of said intake valves being coupled to said intake camshaft, said intake camshaft being rotated by rotation of said gears wherein each said intake valve moves within said associated intake conduit such that each said intake valve is configured for urging a fuel into said associated cylinder when the fuel is introduced into said associated intake conduit.

2. The device of claim 1, further comprising:

a plurality of exhaust conduits, each exhaust conduit extending through said engine block and being in environmental communication with an associated one of said cylinders;

a plurality of exhaust valves, each said exhaust valve being positioned in an associated one of said exhaust conduits; and an exhaust camshaft, each of said exhaust valves being coupled to said exhaust camshaft, said exhaust camshaft being rotated by rotation of said gears wherein each said exhaust valve moves within said associated exhaust conduit such that each said exhaust valve is configured for removal of combusted fuel out of said associated cylinder after the fuel is ignited within said associated cylinder.

3. The device of claim 1, further comprising:

a plurality of exhaust conduits, each exhaust conduit extending through said engine block and being in environmental communication with an associated one of said cylinders, each said exhaust conduit being positioned between said opposed pair of said pistons such that said respective distal end of each of said opposed pair of pistons remains spaced offset from being linearly aligned with said exhaust conduit when said opposed pair of said pistons are each fully extended into said associated one of said cylinders;

a plurality of exhaust valves, each said exhaust valve being positioned in an associated one of said exhaust conduits;

an exhaust camshaft, each of said exhaust valves being coupled to said exhaust camshaft, said exhaust camshaft being rotated by rotation of said gears wherein each said exhaust valve moves within said associated exhaust conduit such that each said exhaust valve is configured for removal of combusted fuel out of said associated cylinder after the fuel is ignited within said associated cylinder.

4. The device of claim 3, further comprising each said intake valve being linearly aligned with an associated one of said exhaust valves.

5. The device of claim 4, further comprising each said intake valve being transversely oriented relative to said associated cylinder.

6. The device of claim 1, further comprising each said cylinder being structured to include a spark plug aperture wherein each said cylinder is configured for ignition of the fuel within each said cylinder by a respective spark plug coupled to said engine block adjacent to said aperture in each said cylinder.

7. A dual piston engine compression device comprising:

an engine block having a plurality of cylinders, each cylinder having a pair of linearly aligned open ends;

a pair of piston crankshafts, each said piston crankshaft being positioned on a respective side of said engine block, each said piston crankshaft being positioned in alignment with said cylinders;

a plurality of pistons, each of said pistons being positioned in an associated one of said cylinders to provide an opposed pair of said pistons within each said cylinder, each of said pistons being operationally coupled to an associated one of said piston crankshafts such that rotation of said piston crankshaft moves said piston within said associated cylinder, each said piston having an end protrusion, said end protrusion being disc-shaped and having a diameter less than a diameter of a main section of said piston, said end protrusion being concentric with said main section of said piston such that said piston has a uniform lip extending around a distal end of said piston;

a pair of gears, each said piston crankshaft being coupled to and rotated by an associated one of said gears, said gears being geared together wherein rotation of said piston crankshafts is coordinated such that said piston crankshafts alternately urge oppositely positioned said pistons together and apart within said associated cylinders as said piston crankshafts rotate;

a plurality of intake conduits, each intake conduit extending through said engine block and being in environmental communication with an associated one of said cylinders, each said intake conduit being positioned between said opposed pair of said pistons such that said distal ends of each of said opposed pair of pistons remains spaced offset from crossing a central longitudinal axis of said intake conduit and only said end protrusion extends over said intake conduit when said opposed pair of said pistons are each fully extended into said associated one of said cylinders;

a plurality of intake valves, each said intake valve being positioned in an associated one of said intake conduits, each said intake valve being transversely oriented relative to said associated cylinder;

an intake camshaft, each of said intake valves being coupled to said intake camshaft, said intake camshaft being rotated by rotation of said gears wherein each said intake valve moves within said associated intake conduit such that each said intake valve is configured for urging a fuel into said associated cylinder when the fuel is introduced into said associated intake conduit;

a plurality of exhaust conduits, each exhaust conduit extending through said engine block and being in environmental communication with an associated one of said cylinders, each said exhaust conduit being positioned between said opposed pair of said pistons such that said respective distal end of each of said opposed pair of pistons remains spaced offset from being linearly aligned with said exhaust conduit when said opposed pair of said pistons are each fully extended into said associated one of said cylinders;

a plurality of exhaust valves, each said exhaust valve being positioned in an associated one of said exhaust conduits, each said intake valve being linearly aligned with an associated one of said exhaust valves;

an exhaust camshaft, each of said exhaust valves being coupled to said exhaust camshaft, said exhaust camshaft being rotated by rotation of said gears wherein each said exhaust valve moves within said associated exhaust conduit such that each said exhaust valve is configured for removal of combusted fuel out of said associated cylinder after the fuel is ignited within said associated cylinder; and each said cylinder being structured to include a spark plug aperture wherein each said cylinder is configured for ignition of the fuel within each said cylinder by a respective spark plug coupled to said engine block adjacent to said aperture in each said cylinder, each said spark plug aperture being positioned proximate said exhaust conduit in said associated cylinder.

* * * * *